US005201592A

United States Patent [19]

Mizutani et al.

[11] Patent Number: 5,201,592

[45] Date of Patent: Apr. 13, 1993

[54] REINKING COLOR RIBBON CASSETTE AND INK RIBBON SELECTION MECHANISM

[75] Inventors: Minoru Mizutani; Masanori Maekawa, both of Tokyo, Japan

[73] Assignee: Oki Elecric Industry Co., Ltd., Tokyo, Japan

[21] Appl. No.: 737,999

[22] Filed: Jul. 30, 1991

[30] Foreign Application Priority Data

Aug. 7, 1990 [JP] Japan ..... 2-207670

[51] Int. Cl.[5] ..... B41J 32/00

[52] U.S. Cl. ..... 400/194; 40/200; 40/201; 40/211; 40/216.1; 40/236

[58] Field of Search ..... 400/194, 195, 196, 196.1, 400/197, 200, 201, 202, 202.1, 202.2, 202.3, 202.4, 211, 212, 206, 206.1, 206.2, 216.1, 216.2, 214, 235, 236

[56] References Cited

U.S. PATENT DOCUMENTS

| | | | |
|---|---|---|---|
| 4,694,305 | 9/1987 | Shiomi | 346/76 PH |
| 5,080,511 | 1/1992 | Iwata | 400/216.1 |

FOREIGN PATENT DOCUMENTS

| | | | |
|---|---|---|---|
| 3417296 | 11/1985 | Fed. Rep. of Germany | 400/216.1 |
| 69189 | 6/1981 | Japan | 400/206.3 |
| 124278 | 7/1985 | Japan | 400/200 |
| 127187 | 7/1985 | Japan | 400/206.3 |
| 27277 | 2/1986 | Japan | 400/236 |
| 37463 | 2/1986 | Japan | 400/216.1 |
| 78685 | 4/1986 | Japan | 400/216.1 |
| 144379 | 7/1986 | Japan | 400/216.1 |
| 154875 | 7/1986 | Japan | 400/216.1 |
| 154880 | 7/1986 | Japan | 400/236 |
| 61-182961 | 8/1986 | Japan . | |
| 205170 | 9/1986 | Japan | 400/236 |
| 217276 | 9/1986 | Japan | 400/236 |
| 61-258771 | 11/1986 | Japan . | |
| 7571 | 1/1987 | Japan | 400/206.3 |
| 62-116180 | 5/1987 | Japan . | |
| 62-160266 | 7/1987 | Japan . | |
| 58201685 | 7/1988 | Japan . | |
| 63-161861 | 10/1988 | Japan . | |
| 302085 | 12/1988 | Japan . | |
| 1-18678 | 1/1989 | Japan . | |
| 2166085 | 4/1986 | United Kingdom | 400/216.2 |

*Primary Examiner*—Edgar S. Burr
*Assistant Examiner*—Eric P. Raciti
*Attorney, Agent, or Firm*—Spencer, Frank & Schneider

[57] ABSTRACT

A reinking color ribbon cassette for a printer is described. The cassette has plural, independent ink ribbons of different colors - such as the primary colors and a black color - and a ribbon feeder for driving only the ink ribbon of a selected color to perform printing through the ink ribbon of the selected color. The ink ribbons can be used repeatedly by feeding their corresponding inks by a color ink feeder. The color ink feeder is constructed of ink tanks, in which inks of the different colors are contained respectively, and ink feeding members. These plural ink ribbons, color ink feeder and ribbon feeder are enclosed within a cassette casing constructed of a lower cover and an upper cover.

27 Claims, 10 Drawing Sheets

REINKING COLOR RIBBON CASSETTE AND INK RIBBON SELECTION MECHANISM

BACKGROUND OF THE INVENTION

1. Field of the Invention

The present invention relates to a serial printer for performing multicolor printing, and especially to a construction for a color ribbon cassette and also to an ink ribbon selection mechanism.

2. Description of the Related Art

Serial printers in the above field have conventionally included those making use of a ribbon cassette with a plurality of color ink feeding means provided therein. After the ribbon containing a desired color is positioned relative to a printing head, the ribbon is driven in unison with a printing operation so that printing is conducted while feeding an ink of the desired color to the ribbon. For example, Japanese Patent Publication No. SHO 63-35435 discloses one example of such ribbon cassettes. The construction and operation of the ribbon cassette disclosed in the above patent publication will next be described in brief. Plural transfer rollers are provided substantially in a central part of the ribbon cassette in such a way that the transfer rollers are stacked one over another and can rotate together. A plurality of color ink feeding means are arranged radially around the transfer rollers. A single, wide, endless ink ribbon is maintained in contact at transfer positions with roller surfaces of the transfer rollers by a biasing means. The transfer rollers also serve as a feeding means for the ink ribbon. When the transfer rollers are rotated in unison with a printing operation, the individual transfer rollers are impregnated with the respective color inks fed from the corresponding color ink feeding means, and the color inks are supplied to the ink ribbon at the transfer positions. An ink wick is provided between each color ink feeding means and its corresponding transfer roller. This ink wick can be separated by a change-over lever when it is not needed. The ribbon cassette can be shifted in a vertical direction relative to the printing head.

In such a conventional ribbon cassette, a single endless ribbon is employed by dividing it into different colors in parallel with the length thereof. If an operator forgets to separate, during printing, the ink wick for each color ink feeding means which is not needed for the printing, the color ink unnecessary for the printing is also supplied, resulting in the problem that the color ink so overfed undergoes "bleeding" to the adjacent color track or tracks.

The conventional ribbon cassette is accompanied by another problem that its dimensions become large as the color ink feeding means are arranged radially around the transfer rollers.

SUMMARY OF THE INVENTION

An object of the present invention is to provide a compact reinking color ribbon cassette and ink ribbon selection mechanism by arranging plural ink ribbons in a stacked relationship in accordance with colors and driving only the ink ribbon required for a printing operation.

The present invention therefore provides a reinking color ribbon cassette for a printer, including a means for shifting ink ribbons in a direction perpendicular to a feeding direction of the ink ribbons to select the ink ribbon of a desired color and a ribbon feeder for being driven by a ribbon drive means to feed the ink ribbon of the desired color. The reinking color ribbon cassette comprises:

plural ink ribbons of different colors arranged independently from one another in a stacked relationship;

plural means for feeding color inks to the respective ink ribbons, said plural color ink feeding means being arranged in a stacked relationship corresponding to the individual ink ribbons;

a means for independently feeding the respective ink ribbons; and a single casing enclosing therein said plural ink ribbons, said plural color ink feeding means and said ink ribbon feeding means.

The ribbon feeding means may preferably comprise a drive gear holder; drive gears stacked corresponding to the plural ink ribbons, respectively, and held by the drive gear holder; idle gear holders; idle gears stacked corresponding to the respective drive gears and held by the respective idle gear holders so that the idle gears are pressed against the corresponding drive gears via the corresponding ink ribbons; a drive shaft engageable with said ribbon drive means to rotate integrally with said ribbon drive means; a shift gear rotatable integrally with the drive shaft; and a shift lever provided in parallel with the drive shaft, said shift lever being engageable in an axial bore of the drive gear corresponding to the ink ribbon selected by the shifting means so that said shift lever can be rotated.

The present invention also provides an ink ribbon selection mechanism for a printer, including a means for shifting ink ribbons in a direction perpendicular to a feeding direction of the ink ribbons to select the ink ribbon of a desired color and a ribbon feeder for being driven by a ribbon drive means to feed the ink ribbon of the desired color. The ink ribbon selection mechanism comprises:

a shift cam for shifting the ink ribbons over different distances, respectively, in the direction perpendicular to the feeding direction of the ink ribbons; and a means for driving the shift cam.

The present invention also provides an ink ribbon selection mechanism for a printer, including a means for shifting ink ribbons in a direction perpendicular to a feeding direction of the ink ribbons to select the ink ribbon of a desired color and a ribbon feeder for being driven by a ribbon drive means to feed the ink ribbon of the desired color. The ink ribbon shifting means is associated with the ribbon feeder to select the ink ribbon of the desired color.

The present invention also provides an ink ribbon selection mechanism for a printer, including a shifter for shifting ink ribbons in a direction perpendicular to a feeding direction of the ink ribbons to select the ink ribbon of a desired color and a ribbon feeder for being driven by a ribbon driver to feed the ink ribbon of the desired color. The ink ribbon selection mechanism comprises:

a reinking color ribbon cassette having plural ink ribbons of different colors arranged independently from one another in a stacked relationship, plural means for feeding color inks to the respective ink ribbons, said plural color ink feeding means being arranged in a stacked relationship corresponding to the individual ink ribbons, a means for independently feeding the respective ink ribbons, a drive gear holder, drive gears stacked corresponding to the respective plural ink ribbons and held by the drive gear holder, idle gear holders, idle gears stacked corresponding to the respective drive gears and held by the respective idle gear holders so that the idle gears are pressed against the corresponding drive gears via the corresponding ink ribbons, a drive shaft engageable with said ribbon drive means to rotate integrally with said ribbon drive means, a shift gear rotatable integrally with the drive shaft, a shift lever provided in parallel with the drive shaft, said shift lever being engageable in an axial bore of the drive gear corresponding to the ink ribbon selected by the shifting means so that said shift lever can be rotated, and a single casing enclosing therein said plural ink ribbons, said plural color ink feeding means, said ink ribbon feeding means, said drive gears, said idle gears, said drive shaft, said shift gear and said shift lever;

a ribbon shifting means having a circular shift cam, which includes on a top surface thereof a cam for shifting the ink ribbons over different distances in the direction perpendicular to the feeding direction of the ink ribbons and on an outer periphery thereof a gear portion, and a drive means which includes a gear maintained in meshing engagement with the gear portion of the shift cam;

a fulcrum for pivotal motion, said fulcrum being provided between both walls of a square U-shaped carriage and the reinking color ribbon cassette arranged between said both walls; and a shift post provided on a bottom surface of the reinking color ribbon cassette, said shift post being in contact with the shift cam.

According to the present invention, a color ribbon required for printing is selected by a combined operation of the ribbon shifting means and ribbon feeding means. It is hence unnecessary for an operator to change over a color ink feeding means, for example, to separate ink wicks. Further, the ribbon feeding means and the color ink feeding means are each stacked corresponding to the ink ribbons so that the reinking color ribbon cassette can be in a compact form. In addition, the ribbon drive means drives only the ink ribbon selected by the combined operation of the ribbon feeding means and the ribbon shifting means so that the ribbon drive means requires only small drive torque. Namely, a small drive motor can be used.

DETAILED DESCRIPTION OF THE PREFERRED EMBODIMENTS

Figure 1:
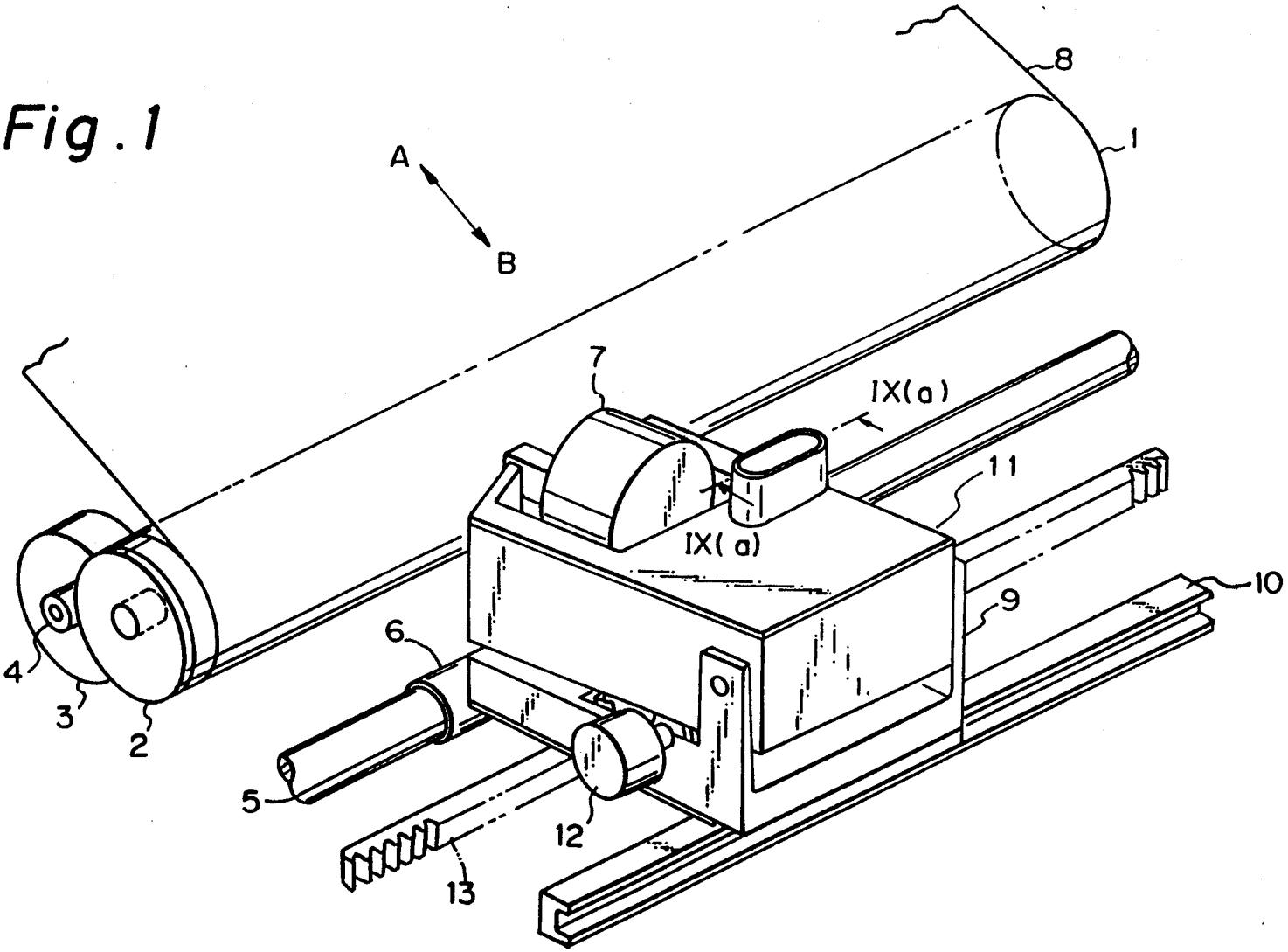
FIG. 1 is a fragmentary perspective view of a printer equipped with a color ribbon cassette according to one embodiment of a first aspect of the present invention.

The reinking color ribbon cassette according to one embodiment of the first aspect of the present invention will hereinafter be described with reference to FIGS. 1 through 3, in which like elements of structure are identified by like reference numerals.

Referring first to FIG. 1, a platen 1 is supported for rotation on an unillustrated side frame. A platen gear 2 which rotates in synchronization with the platen 1 is secured to one end of the platen 1. Like the platen 1, a motor 3 is fixedly mounted on the unillustrated side frame, and a motor gear 4 is fixed on an output shaft of the motor 3. The platen gear 2 is in meshing engagement with the motor gear 4, whereby the platen 1 is rotated by driving the motor 3. A carriage shaft 5 is fixed on the unillustrated side frame and extends in parallel with the platen 1. A printing head 7 is mounted on a carriage frame 6 which moves in parallel with the platen 1 while being guided by the carriage shaft 5. A paper sheet 8 is wrapped on the platen 1 and is fed in the direction of arrows A-B by the motor 3. A carriage 9 is secured on the carriage frame 6. A rear part of the carriage 9 moves together with the carriage frame 6 along a guide rail 10 arranged in parallel with the carriage shaft 5. A color ribbon cassette 11 is pivotally mounted on carriage 9. A shift motor 12 is fixed on the carriage 9 to perform the selection of the ink ribbon of a desired color out of ink ribbons of different colors contained in the color ribbon cassette. A rack 13 is attached to an unillustrated base frame and is maintained in meshing engagement with an unillustrated pinion gear fixed on an output shaft of a motor (not shown) provided underneath the carriage 9, so that rotation of the last-mentioned motor causes the carriage 9 to move in parallel with the platen 1.

Figure 2:
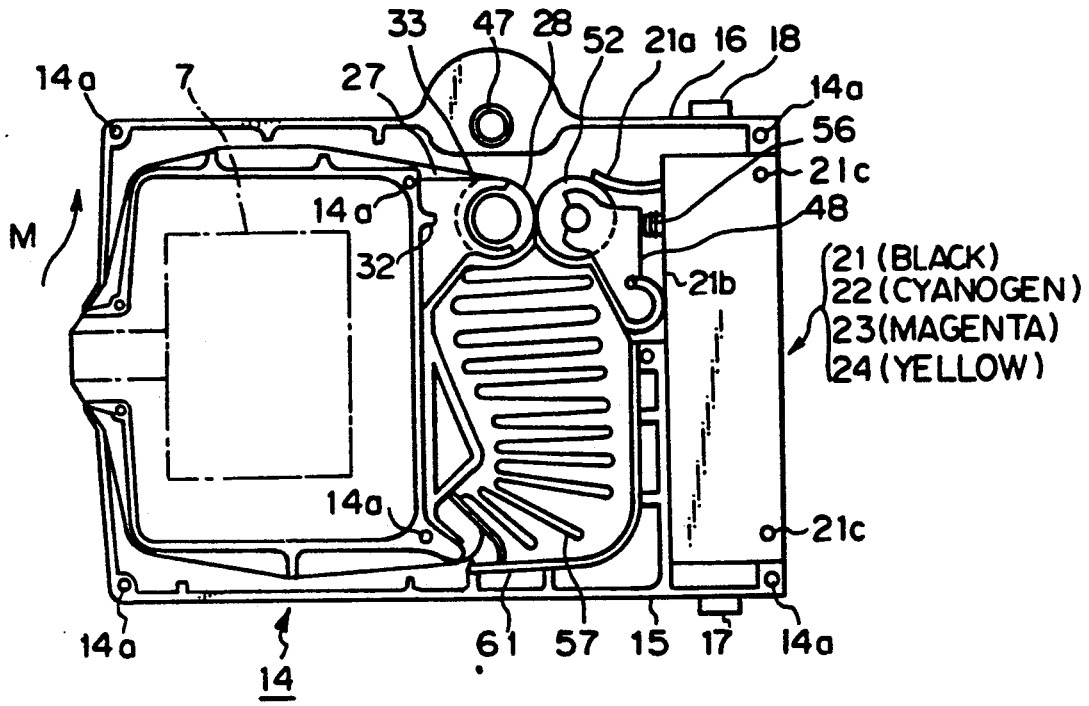
FIG. 2(*a*) is a plan view of the color ribbon cassette of FIG. 1, and FIG. 2(*b*) is a side view of the color ribbon cassette.
Figure 2:
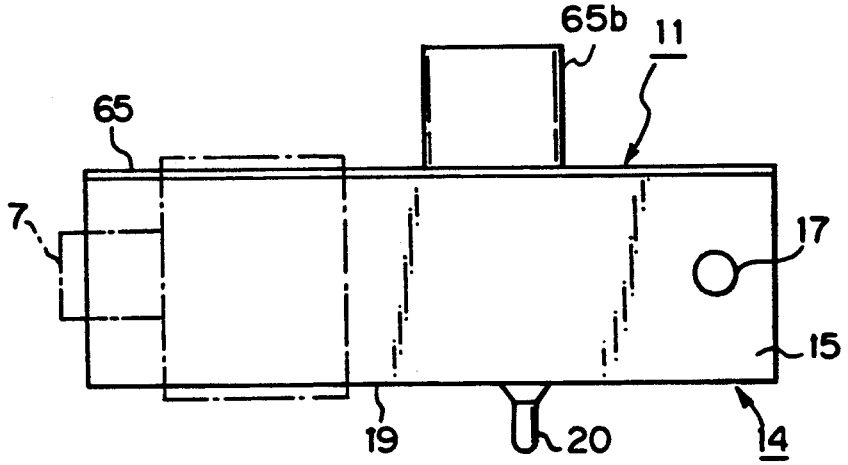
Figure 3:
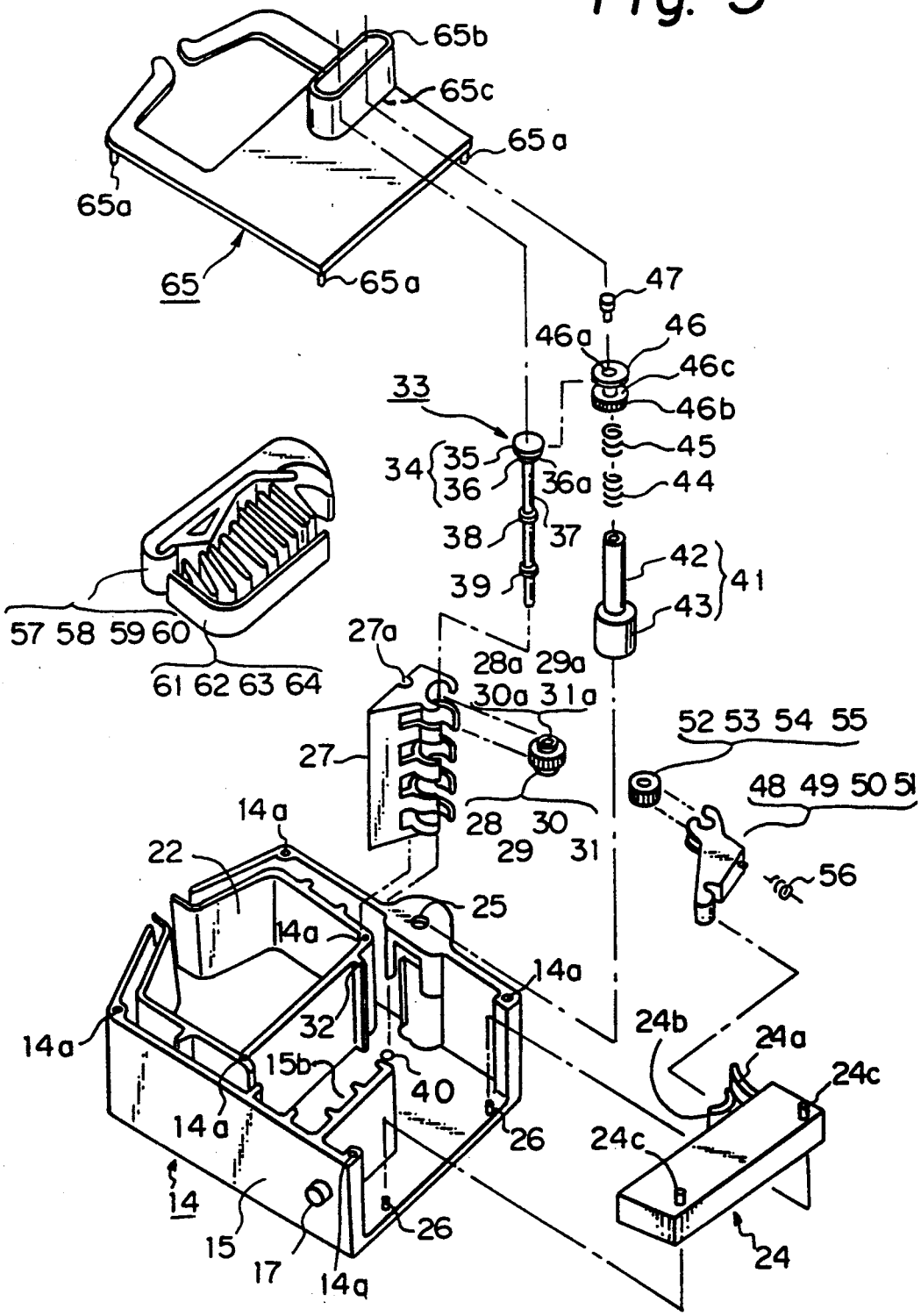
FIG. 3 is an exploded perspective view of the color ribbon cassette of FIG. 1.

In FIG. 2(*a*), an upper cover 65 [see FIG. 2(*b*)] is removed to show the internal construction of the reinking color ribbon cassette. A lower cover 14 has been molded as a single-piece member with a molding material as shown in FIG. 3. Both side walls 15,16 are provided with protrusions 17,18 which act as fulcrums for pivotal motion relative to the carriage 9. A shift post 20, which is one of the members of a ribbon shifting mechanism to be described subsequently, is provided on a back surface 19 of a bottom wall of the lower cover 14 as depicted in FIG. 2(*b*). As ink tanks, four ink tanks 21,22,23,24 are stacked on top of each other within receiving portion 15(*b*). These ink tanks contain color inks, i.e., "black" ink, "cyan" ink, "magenta" ink and "yellow" ink, respectively. In FIG. 3, only the ink tank 24 is shown as the representative of the ink tanks. An ink feeding member 24a and an idle gear holder supporting portion 24b are provided on a side wall of the ink tank 24. Further, projections 24c are provided on a top surface of the ink tank 24 and an unillustrated recesses are formed in a bottom surface of the ink tank 24 at locations corresponding to the projections 24c. As is shown in FIG. 3, the recesses formed in the lowermost "yellow" ink tank 24 engage ink tank posts 26 on the lower cover 14, and the recesses of the "magenta" ink tank 23 engage the projections 24c of the "yellow" ink tank 24. The ink tanks 22,21 are also stacked as described above. A drive gear holder 27 is a bearing which rotatably holds drive gears 28,29,30,31, and has been molded as a single-piece member with a molding material. The drive gear holder 27 defines a fixing slot 27a as shown in FIG. 3, whereby the drive gear holder 27 is fitted on a guide 32 formed on the lower cover 14. A shift lever 33 is constructed of a disk portion 34 and a stem portion 37 and has a substantially T-shaped configuration as viewed from the side. The disk portion 34 has a large-diameter disk 35 and a small-diameter disk 36 united together as an integral member and therefore has a stepped configuration. A gear 36a is provided on an outer peripheral surface of the disk 36. The stem portion 37 is slidable through cruciform, axial bores 28a,29a,30a,31a of the drive gears 28,29,30,31, and has cruciform protrusions 38,39 which engage either one of the axial bores 28a,29a,30a,31a. A hole 40 formed in the lower cover 14 is a relief hole for the shift lever 33. A drive shaft 41 is formed of a fitting portion 43 and a shaft portion 42 having an oval cross-section. The fitting portion 43 is fitted on a ribbon feeding shaft of the ribbon feeding mechanism to be described subsequently, said ribbon feeding shaft being provided on a side of the carriage 9, and the shaft portion 42 is rotatably supported in a slide hole 25 formed in the lower cover 14. Compression springs 44,45 act upon each color change to be described subsequently. A shift gear 46 has a disk-shaped external configuration and defines an oval-shaped, axial bore 46a. A gear 46b is provided on an outer peripheral wall of the shift gear 46. In addition, a groove 46c is centrally formed in the outer peripheral wall along the outer peripheral wall. A post 47 is a stopper for the prevention of any accidental dropping-off of the shift gear 46 from the drive shaft 41, and is press-fitted in a hole formed in a free end of the shaft portion 42 of the drive shaft 41. Idle gear holders 48,49,50,51 are bearings for rotatably holding bosses of idle gears 52,53,54,55, respectively. The idle gear holders 48,49,50,51 are pivotally attached on the ink tanks 21,22,23,24, respectively. For example, the idle gear holder 51 rotatably holds the bosses provided on opposite ends of the idle gear 55 and is pivotally held on the idle gear holder support portion 24b provided on the side wall of the ink tank 24. The idle gear holder 51 presses the idle gear 55 toward the drive gear 31 by a tension spring 56. Four endless ink ribbons 57,58,59,60 are enclosed in subcassettes 61,62,63,64, respectively, and are stacked on the lower cover 14. Upon enclosure of the ink ribbons 57,58,59,60 inside the corresponding subcassettes 61,62,63,64, the ink ribbons are caused to extend between their corresponding drive gears and idle gears. After the above-described parts are enclosed in the lower cover 14, posts 65a of the upper cover 65 are inserted in receiving holes 14a formed in the lower cover 14. A short, oval cylinder extending upwardly from the top surface of the upper cover 65, over opening 65(c), is a protective wall 65b for protecting the shift lever 33 and shift gear 46.

Figure 4:
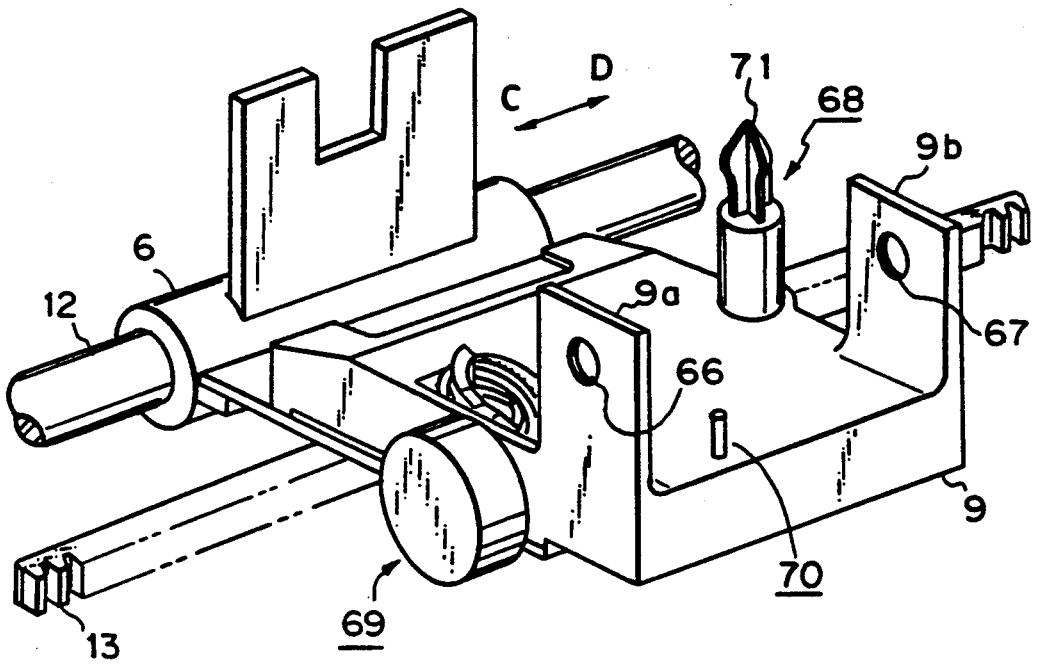
FIG. 4 is a perspective view of a carriage in an ink ribbon selection mechanism according to one embodiment of a second aspect of the present invention.

The carriage 9 will next be described in detail with reference to FIG. 4. The rear (relative to the printing side) part of the carriage 9 is shaped in the form of U. Both side walls 9a,9b define fitting holes 66,67 in which the protrusions 17,18 formed on the side walls 15,16 of the ribbon cassette 11 engage. Relative to the printing side, the aforementioned ribbon feeding mechanism 68 is provided on the right-hand side while a ribbon shifting mechanism 69 is provided on a left-hand side. Further, a resetting means 70 (FIG. 5) for resetting the ribbon cassette 11 is provided on a rear side. The ribbon feeding mechanism 68 includes an unillustrated gear which is maintained in meshing engagement with the rack 13. When the carriage frame 6 travels in the direction of arrows C-D, the unillustrated gear rotates along the rack 13 so that a ribbon feeding shaft 71 meshing with the unillustrated gear rotates.

The ribbon shifting mechanism will now be described in detail with reference to FIG. 5. A recess 9c is formed in the carriage 9. A shift cam 73 is rotatably fitted on a shaft 72 which extends from a bottom wall of the recess 9c. Teeth 74 are provided on an outer peripheral wall of the shift cam 73. A pulse motor 75 is provided on a side wall of the carriage 9, and a worm gear 76 is fixed on an output shaft of the pulse motor 75. The worm gear 76 is maintained in meshing engagement with the teeth 74 provided on the outer peripheral wall of the shift cam 73. The shift cam 73 is rotated in the direction of arrows E-F by the pulse motor 75.

Figure 7:
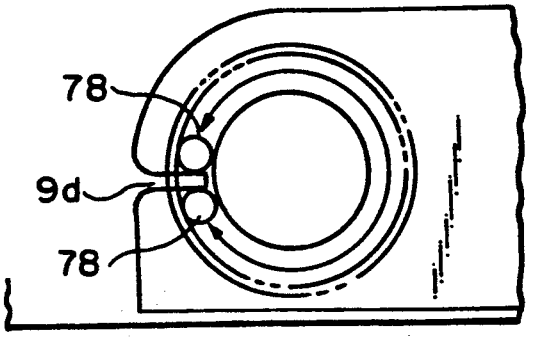
FIG. 7 is a schematic illustration of an operation of a stopper in the ink ribbon selection mechanism.

Referring next to FIGS. 6(a) through 6(c) and 7, the shift cam will be described in detail. On a top surface of the shift cam 73, four cam surfaces 73a,73b, 73c,73d of different heights are provided in the order of descending heights. Except for the junction between the cam surface 73a and the cam surface 73d, the individual cam surfaces are connected with a tilted surface interposed therebetween. An attachment hole 77 formed in a central part of the shift cam 73 is fitted on the shaft 72 shown in FIG. 5 so that the shift cam 73 is allowed to rotate. A stopper 78 is provided on a bottom surface of the shift cam 73 so that, when the shift cam 73 has made approximately a full turn, the stopper 78 is brought into contact with a wall 9d formed on the carriage 9 as illustrated in FIG. 7. When contacted, the pulse motor 75 loses synchronization and, when this state remains for a predetermined period of time, the pulse motor 75 is stopped.

Figure 8:
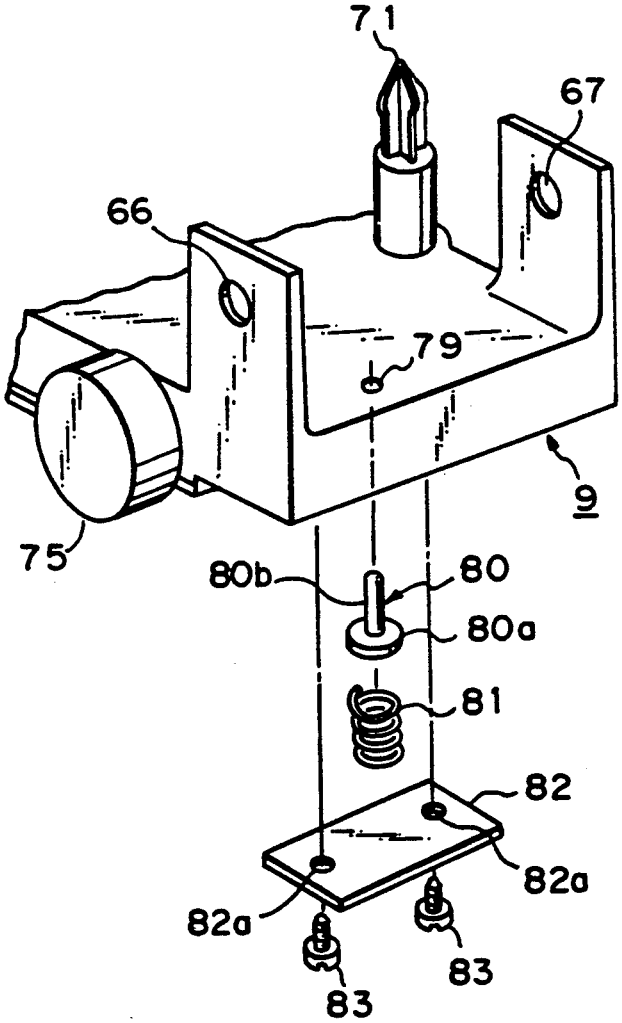
FIG. 8 is an exploded perspective view of a resetting means in the ink ribbon selection mechanism.

The resetting means will next be described in detail with reference to FIG. 8. The carriage 9 defines a stepped counterbore 79 formed from the side of the back surface. After a stepped post 80 and a compression spring 81 are placed inside the counterbore 79, a plate 82 is secured by means of screws 83. The stepped post 80 is urged by the force of the compression spring 81 so that a flange portion 80a is maintained in contact with an unillustrated stepped portion of the stepped counterbore 79. As a result, a post portion 80b extends upwardly through the counterbore 79.

Figure 9A:
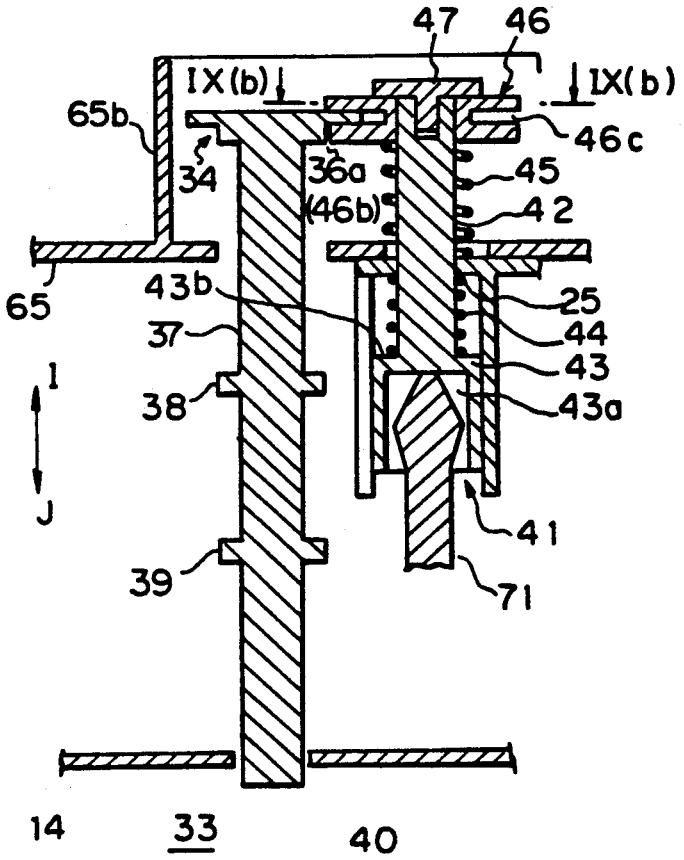
FIG. 9(*a*) is a cross-sectional view seen in the direction of arrows IX(a)—IX(a) in FIG. 1 and shows a ribbon feeding mechanism in the ribbon cassette of FIG. 1, whereas FIG. 9(*b*) is a cross-sectional view seen in the direction of arrows IX(b)—IX(b) in FIG. 9(*a*)
Figure 9B:
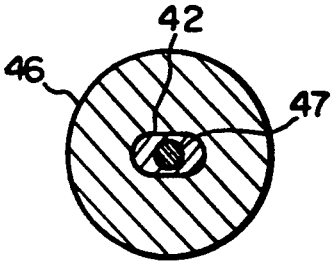

The ribbon feeding mechanism of the ribbon cassette will now be described in detail with reference to FIGS. 9(a) and 9(b). To show the relationship between the shift lever 33 and the drive shaft 41, the drive gears are omitted in FIG. 9(a). Description of the shift lever 33 is omitted since it has already been described in detail with reference to FIG. 3. The drive shaft 41 has a stepped configuration. A cruciform fitting bore 43a is defined in the fitting portion 43 which is fitted on the ribbon feeding shaft 71. The fitting bore 43a is fitted on a free end portion of the ribbon feeding shaft 71. Further, the shaft portion 42 and the axial bore 46a of the shift gear 46 are both oval in cross-section as illustrated in FIG. 9(*b*), and the shaft portion 42 is slidable along the slide hole 25 formed in the lower cover 14 (see FIG. 3). The two compression springs 44,45 are provided on opposite sides relative to the slide slot 25. The spring 44 is provided between a stepped portion 43b, which is located between the fitting portion 43 and the shaft portion 42, and a portion of the lower cover 14, said portion surrounding the slide hole 25, whereby the spring 44 normally urges the drive shaft 41 toward the ribbon feed shaft 71. On the other hand, the spring 45 is disposed between the slide hole 25 and the shift gear 46 and normally urges the shift gear 46 in the upward direction as viewed in FIG. 9(*a*). The post 47 is press-fitted in the drive shaft 41 and is serving as a stopper for the shift gear 46. Regarding the power relationship between the compression spring 44 and the compression spring 45, the compression spring 44 is stronger. Between the shift gear 46 and the shift lever 33, the gear 46b and the gear 36a are maintained in meshing engagement and a stepped portion of the disk portion 34 is rotatably received in the groove 46c. Accordingly, the drive shaft 41 and the shift lever 33 extend in parallel with each other. The shift lever 33 and the shift gear 46 are movable in the direction of arrows I-J, always as an integral unit.

Figure 10A:
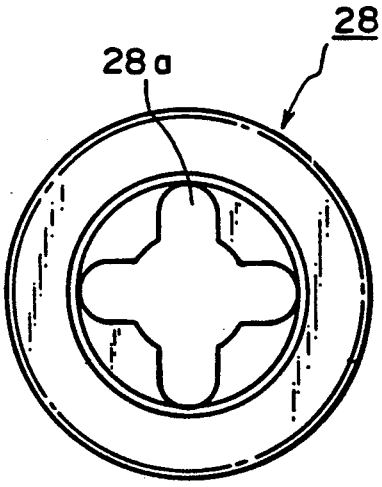
FIG. 10(*a*) is a detailed plan view of an axial bore of a drive gear in the ribbon cassette of FIG. 1, and FIG. 10(*b*) is a side view of the axial bore.
Figure 10B:
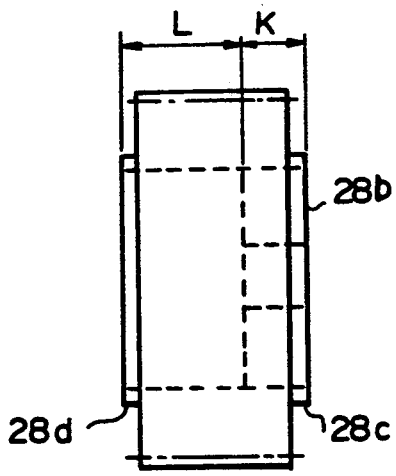

The axial bore of each drive gear is illustrated in detail in FIGS. 10(*a*) and 10(*b*). The drive gear 28 is shown in these drawings. Bosses 28c,28d are provided on opposite end surfaces of the drive gear 28. The cruciform, axial bore 28a extends from one of the end surfaces of the boss 28c, namely, from the end surface 28b over the distance indicated by the dimension K. On the other hand, a circular hole whose diameter is larger than the maximum diameter of the cruciform, axial bore 28a is formed in the range indicated by the dimension L.

Figure 11B:
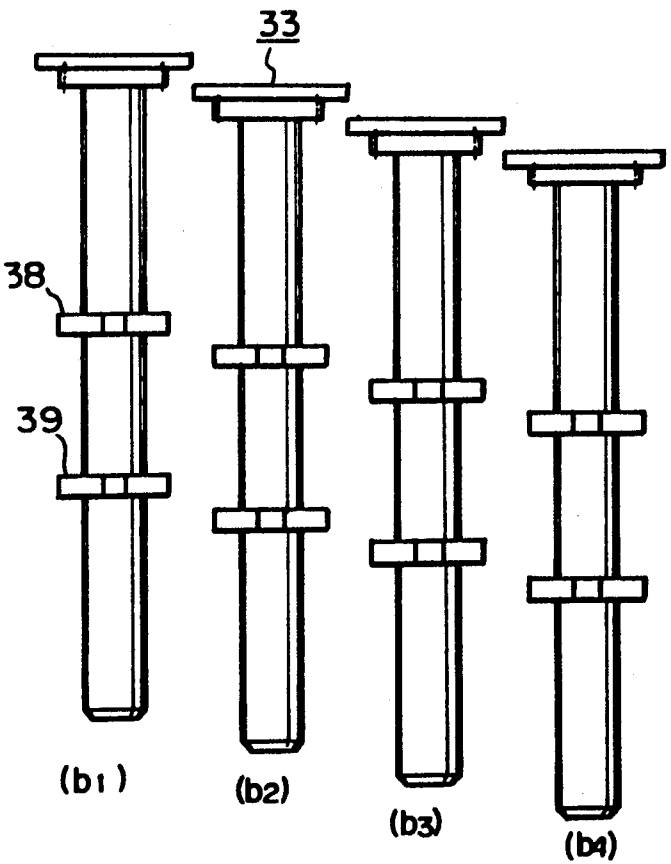
FIGS. 11(*a*) and 11(*b*) diagrammatically illustrate the relationship between a drive gear and a shift lever in the ribbon cassette of FIG. 1, in which the positions of the drive gears are illustrated in FIG. 11(*a*) and the positions of a shift lever are shown in FIG. 11(*b*)
Figure 11:
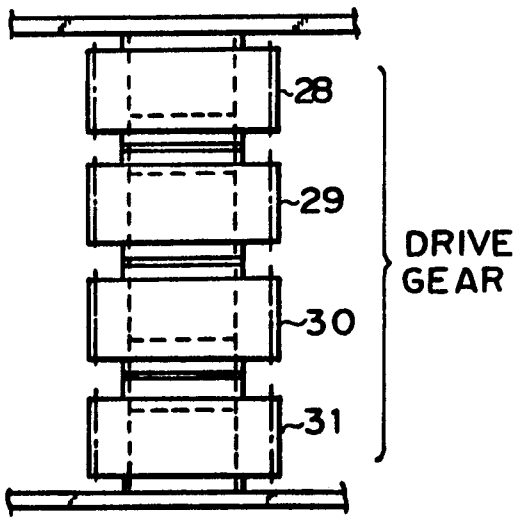
Figure 12A:
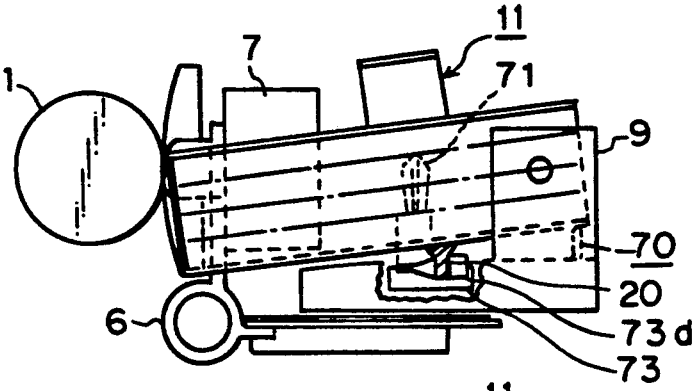
FIGS. 12(*a*) through 12(*d*) diagrammatically depict a state of the ribbon shifting mechanism in the ribbon cassette according to the first embodiment of the present invention.
Figure 12B:
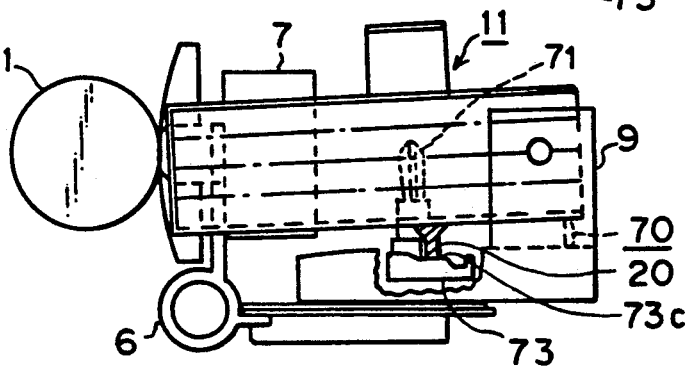
Figure 12C:
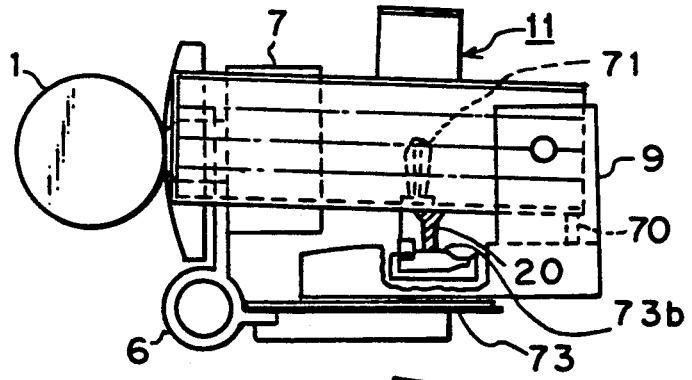
Figure 12D:
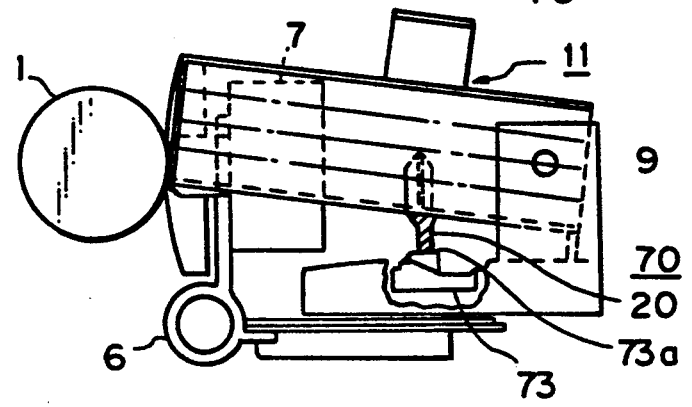

The relationship between the drive gear and the shift lever will now be described with reference to FIGS. 11(*a*) and 11(b). FIG. 11(*a*) illustrates the four drive gears 28,29,30,31 assembled in the ribbon cassette. The drive gears 28,29,30,31 are arranged with the cruciform, axial bores 28a,29a facing each other and the cruciform, axial bores 30a,31a facing each other. FIG. 11(*b*) shows, at different shift positions, the shift lever 33 inserted in the drive gears 28,29,30,31 depicted in FIG. 11(*a*). When the shift lever 33 is at the position $b_1$ shown in FIG. 11(*b*), the cruciform protrusion 38 is in engagement with the cruciform, axial bore 28a of the uppermost drive gear 28. Similarly, when the shift lever 33 is at the position $b_2$ illustrated in FIG. 11(*b*), the cruciform protrusion 38 is in engagement with the axial bore 29a of the second drive gear 29. When the shift lever 33 is at the position $b_3$ depicted in FIG. 11(*b*), the cruciform protrusion 39 is in engagement with the axial bore 30a of the third drive gear 30. When the shift lever 33 is at the position $b_4$ shown in FIG. 11(*b*), the cruciform protrusion 39 is in engagement with the axial bore 31a of the lowermost drive gear 31.

Operation of the ink ribbon selection mechanism will next be described with reference to FIGS. 12(*a*) through 12(*d*), which illustrate the ribbon shifting mechanism in different states.

Figure 5:
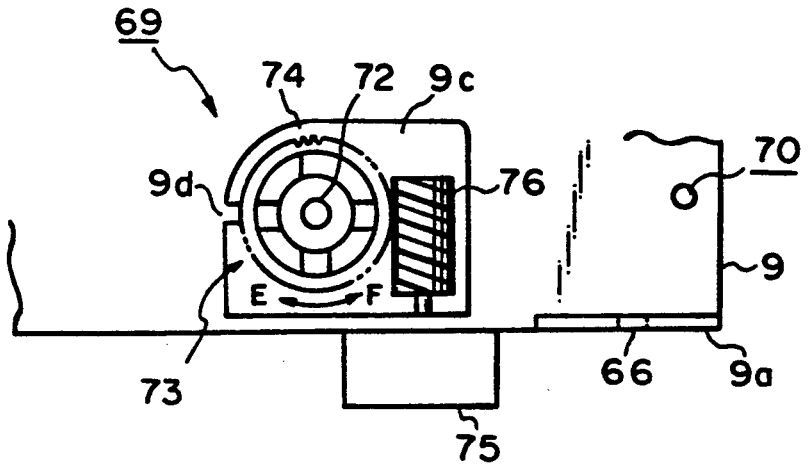
FIG. 5 illustrates in detail a ribbon shifting mechanism in the ink ribbon selection mechanism.
Figure 6A:
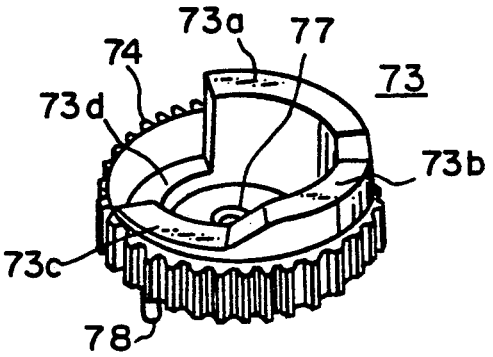
FIG. 6(*a*) is a perspective view of a shift cam mechanism in the ink ribbon selection mechanism, FIG. 6(*b*) is a plan view of the shift cam mechanism, and FIG. 6(*c*) is a side view of the shift cam mechanism.
Figure 6B:
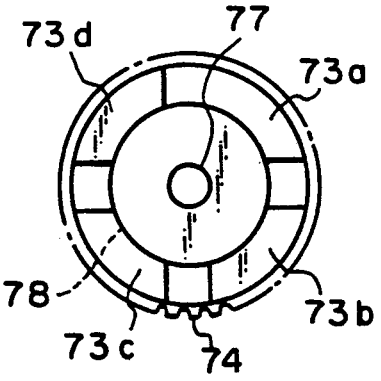
Figure 6C:
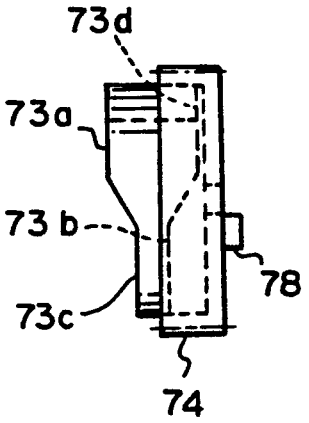

FIG. 12(*a*) illustrates the state achieved when the pulse motor 75 shown in FIG. 5 has selected "black", namely, the uppermost ink ribbon in accordance with a selection signal from an unillustrated control unit. In this state, the shift post 20 of the ribbon cassette 11 is in contact with the lowest cam surface 73d of the shift cam 73, said lowest cam surface 73d being illustrated in FIGS. 6(*a*) and 6(*b*). Since the drive shaft 41 shown in FIG. 9(*a*) is maintained in contact with the ribbon feeding shaft 71 by the compression spring 44 at this time, the shift lever 33 is at the position $b_1$ shown in FIG. 11(*b*). Accordingly, the cruciform protrusion 38 of the shift lever 33 is in engagement with the cruciform, axial bore 28a of the drive gear 28. When a printing operation is started in this state, the rotary force of the ribbon feeding shaft 71 is transmitted to the drive gear 28 by way of the drive shaft 41, shift gear 46 and shift lever 33 so that the "black" ink ribbon 57 is fed in the direction of arrow M by the drive gear 28 and the idle gear 52 as illustrated in FIG. 2(*a*). FIG. 12(*b*) similarly shows the state achieved when the "cyan" ink ribbon 58 has been selected. The shift post 20 of the ribbon cassette 11 is in contact with the cam surface 73c of the shift cam 73. At this time, the shift lever 33 is at the position $b_2$ shown in FIG. 11(*b*). Therefore, the cruciform protrusion 38 of the shift lever 33 is in engagement with the cruciform, axial bore 29a of the drive gear 29. When a printing operation is started in this state, the "cyan" ink is fed in the direction of arrow M. Similarly, FIGS. 12(*c*) and 12(*d*) show the states attained when the "magenta" and "yellow" ink ribbons 59,60 have been selected, respectively.

Since the resetting means 70 acts to lift the rear part of the ribbon cassette 11, the shift post 20 is always urged against either one of the cam surfaces. When the position of the ribbon cassette 11 has been changed from the state shown in FIG. 12(*d*) to that illustrated in FIG. 12(*a*), the drive shaft 41 is caused to abruptly project out through the top surface of the upper cover 65 of the ribbon cassette 11 because the drive shaft is always maintained in contact with the ribbon feeding shaft 71 as shown in FIG. 9(*a*). Concurrently with this, the shift gear 46 and the shift lever 33 follow the drive shaft 41 while being urged upwardly in the direction of arrow I by the compression spring 45. This is because, when the protrusion 39 of the shift lever 33 passes through the axial bore 31a of the drive gear 31, the protrusion 39 is not always allowed to pass through the axial bore 30a of the next drive gear 30 and the protrusion 39 is brought into contact with the lower boss of the drive gear 30. Since the shift gear 46 is rotating together with the drive shaft 41 at this time, the shift lever 33 also rotates so that the protrusion 39 rotates on the lower boss of the drive gear 30. When the cruciform configuration of the protrusion 39 is registered with the cruciform configuration of the axial bore 30a, the protrusion 39 enters the axial bore 30a and then passes through the axial bore 30a. The shift lever 33 is lifted further in the direction of arrow I so that, this time, the protrusion 38 of the shift lever 33 is brought into contact with the lower boss of the drive gear 29. The protrusion 38 is then allowed to pass through the axial bore 29a in much the same way as described above, and is brought into contact with the lower boss of the drive gear 28. The protrusion 38 similarly rotates relative to the axial bore 28a so that the protrusion enters the axial bore 28a. Since the shift gear 46 is brought into the post 47 at this time, the protrusion 38 of the shift lever 33 is brought into engagement with the axial bore 28a of the drive gear 28 so that the ribbon cassette 11 takes the position shown in FIG. 12(*a*). When the ribbon cassette 11 has been changed from the position of FIG. 12(*a*) to the position of FIG. 12(*d*), a force corresponding to the difference in force between the compression spring 44 and the compression spring 45 acts on the drive shaft 41. Since the power relationship between the compression spring 44 and the compression spring 45 is set to allow the compression spring 44 to exert a stronger force as described above, force is applied in the direction of arrow J to the drive shaft 41. After a similar operation to that described above is performed, the protrusion 39 of the shift lever 33 is brought into engagement with the axial bore 31a of the drive gear 31.

In the embodiment described above, the resetting means was provided to bring the shift post into contact with the shift cam. The resetting means can however be omitted provided that the ribbon cassette has a sufficient weight.

The fulcrums for pivotal motion, which were provided between the carriage and the ribbon cassette, were formed by forming the holes in the carriage and providing protrusions on the ribbon cassette. As an alternative, protrusions can be formed on the carriage and recesses can be formed in the ribbon cassette.

Further, the protrusions of the shift lever can be formed in the form of a bar extending in opposite directions relative to the shift lever.

The lower cover of the ribbon cassette was formed as a single-piece member by molding or the like. Its side wall and bottom wall can however be molded separately, followed by assembly.

We claim:

1. A reinking color ribbon cassette for a printer, comprising (a) plural ink ribbons of different colors, said ink ribbons being arranged independently from one another in a stacked relationship;

(b) shifting means for selecting at least one ink ribbon of a desired color, said shifting means shifting said ink ribbons in a direction perpendicular to a feeding direction of said ink ribbons;

(c) plural ink feeding means for feeding color inks to the response ink ribbons, said ink feeding means being arranged in a stacked relationship corresponding to said ink ribbons;

(d) ribbon drive means for driving a ribbon feeder;

(e) ribbon feeding means for independently feeding the respective ink ribbons, said ribbon feeding means including (1) a drive gear holder;

(2) drive gears having axial bores stacked corresponding to said ink ribbons, respectively, said drive gears being held by said drive gear holder;

(3) idle gear holders;

(4) idle gears stacked corresponding to said respective drive gears, each said idle gear being held by said respective idle gear holder so that each idle gear is pressed against a corresponding drive gear with a corresponding ink ribbon being pressed therebetween;

(5) a drive shaft engageable with said ribbon drive means, said drive shaft rotating integrally with said ribbon drive means;

(6) a shift gear rotatable integrally with said drive shaft; and (7) a shift lever provided in parallel with said drive shaft, said shift lever being engageable in an axial bore of the drive gear corresponding to the ink ribbon selected by said shifting means so that said shift lever can be rotated; and (f) a single casing enclosing therein said ink ribbons, said ink feeding means and said ribbon feeding means.

2. A reinking color ribbon cassette as defined in claim 1 further comprising subcassettes, wherein each said ink ribbon is stored in a separate subcassette, said single casing has a receiving portion defined by receiving walls, and said subcassettes are stacked in said receiving portion and are held between said receiving walls.

3. A reinking color ribbon cassette as defined in claim 1, wherein said ink feeding means and said single casing include engagement means for fitting said ink feeding means and said single casing together.

4. A reinking color ribbon cassette as defined in claim 1, wherein each said ink ribbon has a width and each said width has a midpoint, said ink ribbons are adjacent to one another whereby said widths are longitudinally arranged, and the midpoints of two adjacent ink ribbons define a shift distance, and wherein each said drive gear has a disk-shaped main body, teeth of a width substantially equal to the width of each said corresponding ink ribbon on a peripheral surface thereof, and bosses provided on opposite end surfaces of said disc-shaped main body, each said axial bore having an effective length substantially equal to said shift distance extending from an end surface of one of said bosses.

5. A reinking color ribbon cassette as defined in claim 4, wherein said drive gear holder is mounted on said single casing, said drive gear holder has alternating holding portions and slots, each said holding portion rotatably holding the bosses of the corresponding drive gear, and each said slot being fitted with said disk-shaped main body of the corresponding drive gear.

6. A reinking color ribbon cassette as defined in claim 5, wherein said shift gear is formed of a short cylindrical block, said short cylindrical block having an outer peripheral wall defining an axial bore centrally formed in said block, the axial bore of said shift gear having an oval shape in cross-section, said shift gear having a toothed portion in said outer peripheral wall, and a groove centrally formed in the toothed portion along the outer peripheral wall.

7. A reinking color ribbon cassette as defined in claim 1, wherein each said ink ribbon has a width; and each said idle gear has a disk-shaped main body, teeth of a width substantially equal to the width of each said corresponding ink ribbon on a peripheral surface thereof, and bosses provided on opposite end surfaces of said disk-shaped main body.

8. A reinking color ribbon cassette as defined in claim 7, wherein each said idle gear holder has a holding portion on which each said corresponding idle gear is rotatably held at the bosses thereof, and a pivotal portion for biasing each said corresponding idle gear toward the corresponding drive gear.

9. A reinking color ribbon cassette as defined in claim 8, wherein said ink feeding means is partially defined by a side wall facing said corresponding drive gear, said side wall has a fulcrum supporting said pivotal portion for pivotal movement, and wherein said ink feeding means has a biasing member disposed on the side wall to bias each said corresponding idle gear holder.

10. An ink ribbon selection mechanism for a printer, including ribbon shifting means for shifting an ink ribbon in a direction perpendicular to a feeding direction of the ink ribbons to select the ink ribbon of a desired color, a ribbon feeder to feed to the ink ribbon of the desired color, and ribbon drive means for driving the ribbon feeder, comprising:

a reinking color ribbon cassette having plural ink ribbons of different colors arranged independently from one another in a stacked relationship, and a bottom surface, plural ink feeding means for feeding color inks to the respective ink ribbons, said ink feeding means being arranged in a stacked relationship corresponding to the individual ink ribbons, a ribbon feeding means for independently feeding the respective ink ribbons, a drive gear holder, drive gears having axial bores and stacked corresponding to said respective ink ribbons and held by said drive gear holder, idle gear holders, idle gears stacked corresponding to said respective drive gears and held by said respective idle gear holders so that each said idle gear is pressed against each said corresponding drive gear with each said corresponding ink ribbon being pressed therebetween, a drive shaft engageable with said ribbon drive means to rotate integrally with said ribbon drive means, a shift gear rotatable integrally with said drive shaft, a shift lever provided in parallel with said drive shaft and being engageable in said axial bore of the drive gear corresponding to said ink ribbon selected by the ribbon shifting means so that said shift lever can be rotated, and a single casing enclosing therein said ink ribbons, said ink feeding means, said ribbon feeding means, said drive gears, said idle gears, said drive shaft, said shift gear and said shift lever;

a ribbon shifting means having a circular shift cam, said shift cam including on a top surface thereof a cam for shifting said ink ribbons over different distances in the direction perpendicular to a feeding direction of said ink ribbons and on an outer periphery thereof a gear portion, and a drive means which includes a gear maintained in meshing engagement with the gear portion of said shift cam;

a square U-shaped carriage having a fulcrum for pivotal motion, said carriage having at least two walls, said fulcrum being provided between said walls, said reinking color ribbon cassette arranged between said walls, and a shift post provided on the bottom surface of said reinking color ribbon cassette, said shift post being in contact with said shift cam.

11. The mechanism of claim 10, further comprising subcassettes, wherein each said ink ribbon is stored in a separate subcassette, said single casing has a receiving portion defined by receiving walls, and said subcassettes are stacked in said receiving portion and are held between said receiving walls.

12. The mechanism of claim 10, wherein said ink feeding means and said single casing include engagement means for fitting said ink feeding means and said single casing together.

13. The mechanism of claim 10, wherein each said ink ribbon has a width and each said width has a midpoint, said ink ribbon are adjacent to one another whereby said widths are longitudinally arranged, and the midpoints of two adjacent ink ribbons define a shift distance, and wherein each said drive ink ribbons define a shift distance, and wherein each said drive gear has a disk-shaped main body, teeth of a width substantially equal to the width of each said corresponding ink ribbon on a peripheral surface thereof, and bosses provided on opposite end surfaces of said disc-shaped main body, each said axial bore having an effective length substantially equal to said shift distance extending from an end surface of one of said bosses.

14. The mechanism of claim 13, wherein said drive gear holder is mounted on said single casing, said drive gear holder has alternating holding portions and slots, each said holding portion rotatably holding the bosses of the corresponding drive gear, and each said slot being fitted with said disk-shaped main body of the corresponding drive gear.

15. The mechanism of claim 14, wherein said shift gear is formed of a short cylindrical block said short cylindrical block having an outer peripheral wall defining an axial bore centrally formed in said block, the axial bore of said shift gear having an oval shape in cross-section, said shift gear having a toothed portion in said outer peripheral wall, and a groove centrally formed in the toothed portion along the outer peripheral wall.

16. The mechanism of claim 10, wherein each said ink ribbon has a width; and each said idle gear has a disk-shaped main body, teeth of a width substantially equal to the width of each said corresponding ink ribbon on a peripheral surface thereof, and bosses provided on opposite end surfaces of said disk-shaped main body.

17. The mechanism of claim 16, wherein each said idle gear holder has a holding portion on which each said corresponding idle gear is rotatably held at the bosses thereof, and a pivotal portion for biasing each said corresponding idle gear toward the corresponding drive gear.

18. The mechanism of claim 17, wherein said ink feeding means is partially defined by a side wall facing said corresponding drive gear, said side wall has a fulcrum supporting said pivotal portion for pivotal movement, and wherein said ink feeding means has a biasing member disposed on the side wall to bias each said corresponding idle gear holder.

19. A reinking color ribbon cassette as defined in claim 6, wherein said single casing has a slide hole defining top and bottom openings, and wherein said drive shaft comprises (a) a fitting portion having a first biasing member relative to said bottom opening and being fitted with said ribbon drive means and;

(b) a shaft portion having an oval cross-section, and being slidable and axially located through said slide hole, and having a second biasing member relative to said top opening;

wherein said shift gear is located towards an end of the shaft portion, and the second biasing member is located between said top opening and the shift gear, whereby the drive shaft is maintained in contact with said ribbon drive means by a difference in pressing force between the first biasing member and the second biasing member so that the drive shaft and the ribbon drive means rotate together.

20. A reinking color ribbon cassette as defined in claim 19, wherein said shift lever further comprises a stem portion having (a) first and second disks provided at one end, said first disk having on an outer peripheral surface thereof a toothed portion meshed with the toothed portion of the shift gear, and said second disk being rotatably held in the groove of the shift gear;

(b) a protrusion engageable with the drive gear axial bore corresponding to said ink ribbon selected by said shifting means;

whereby said stem portion is provided in parallel with said drive shaft and is axially located and slidable through each drive gear axial bore.

21. A reinking color ribbon cassette as defined in claim 20, wherein said single casing has an upper cover defining a top and a bottom side, an opening, and a protective wall extending toward a side of said shift gear and surrounding the opening on the top side, said shift gear and said shift lever extending in a direction towards the top side through the opening and being surrounded by said protective wall.

22. A reinking color ribbon cassette as defined in claim 1, wherein said single casing has an upper cover defining a top and a bottom side, an opening, and a protective wall surrounding the opening on the top side and extending toward a side of said shift gear, said shift gear and said shift lever extending in a direction towards the top side through the opening and being surrounded by said protective wall.

23. A reinking color ribbon cassette as defined in claim 1 wherein said shifting means comprises (a) a shift cam for shifting said ink ribbons over different distances, respectively, and;

(b) cam driving means for driving said shift cam.

24. The reinking color ribbon cassette as defined in claim 1, wherein said shifting means is associated with said ribbon feeding means for selecting and feeding at least one ink ribbon of the desired color.

25. The mechanism of claim 15, wherein said single casing has a slide hole defining top and bottom openings, and wherein said drive shaft comprises (a) a fitting portion having a first biasing member relative to said bottom opening and being fitted with said ribbon drive means and;

(b) a shaft portion having an oval cross-section, and being slidable and axially located through said slide hole, and having a second biasing member relative to said top opening;

wherein said shift gear is located towards an end of the shaft portion, and the second biasing member is located between said top opening and the shift gear, whereby the drive shaft is maintained in contact with said ribbon drive means by a difference in pressing force between the first biasing member and the second biasing member so that the drive shaft and the ribbon drive means rotate together.

26. The mechanism of claim 25, wherein said shift lever further comprises a stem portion having (a) first and second disks provided at one end, said first disk having an outer peripheral surface thereof a toothed portion meshed with the toothed portion of the shift gear, and said second disk being rotatably held in the groove of the shift gear;

(b) a protrusion engageable with the drive gear axial bore corresponding to said ink ribbon selected by said shifting means;

wherein said stem portion is provided in parallel with said drive shaft and is axially located and slidable through each drive gear axial bore.

27. The mechanism of claim 26, wherein said single casing has an upper cover defining a top and a bottom side, an opening, and a protective wall extending toward a side of said shift gear and surrounding the opening on the top side, said shift gear and said shift lever extending in a direction towards the top side through the opening and being surrounded by said protective wall.

* * * * *